United States Patent [19]

Schwob

[11] Patent Number: 4,499,367

[45] Date of Patent: Feb. 12, 1985

[54] DEVICE AND METHOD FOR WAX DEPILATION

[75] Inventor: Pierre Schwob, Lyons, France

[73] Assignee: SEB S.A., Selongey, France

[21] Appl. No.: 501,903

[22] Filed: Jun. 7, 1983

[30] Foreign Application Priority Data

Jun. 16, 1982 [FR] France ..... 82 10478

[51] Int. Cl.[3] ..... F27B 14/00

[52] U.S. Cl. ..... 219/421; 128/341; 128/355; 219/425; 219/435; 219/328; 222/146.5; 401/2

[58] Field of Search ..... 128/341, 342, 343, 345, 128/355; 219/311, 328, 421, 422, 423, 424, 425, 435, 436, 441, 442; 401/2, 172, 180; 222/146 HE; 126/343.5 R, 343.5 A; 8/447

[56] References Cited

U.S. PATENT DOCUMENTS

| | | | |
|---|---|---|---|
| 3,377,466 | 4/1968 | Paulsen | 219/421 |
| 3,792,801 | 2/1974 | Baker et al. | 222/146 HE |
| 3,858,985 | 1/1975 | Fiveash | 401/2 |
| 3,876,105 | 4/1975 | Kelling | 219/421 X |
| 3,964,645 | 6/1976 | Scholl | 222/146 HE |
| 4,308,447 | 12/1981 | Nötzold et al. | 219/421 |
| 4,360,046 | 11/1982 | Streit et al. | 141/82 |

*Primary Examiner*—Volodymyr Y. Mayewsky
*Attorney, Agent, or Firm*—Young & Thompson

[57] ABSTRACT

A drawing recipient borne by a body is associated with heating means. A filtering recipient is also associated with heating means and in the operational position is raised and laterally off-set with respect to the drawing recipient. A spout serves as a spill-way from the bottom of the filtering recipient to the drawing recipient. The filtering recipient is pivotably mounted with respect to the body, between the aforesaid operational position in which it overhangs the body, and a fold-away position in which it is brought back over the drawing recipient.

10 Claims, 6 Drawing Figures

Figure 1:
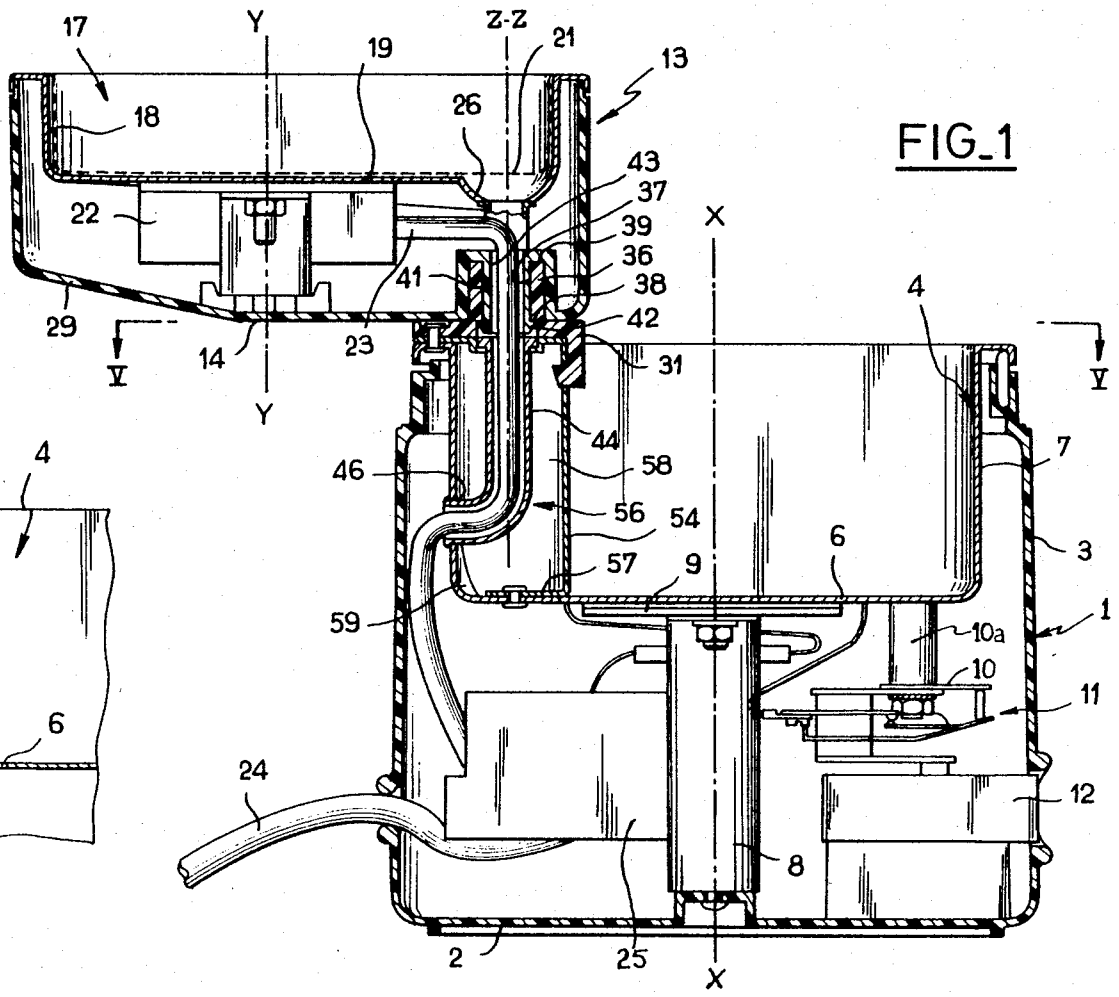

X
X
Y
Y
Z-Z
1
2
3
4
6
7
8
9
10
10a
11
12
13
14
17
18
19
21
22
23
24
25
26
29
31
36
37
38
39
41
42
43
44
46
54
56
57
58
59

U
U
1
3
4
6
7
13
14
16
17
18
19
26
27
47
48
52
53
54
56
57
59

DEVICE AND METHOD FOR WAX DEPILATION

The present invention relates to a device for wax depilation.

The present invention further relates to a method for wax depilation.

As is known, wax depilation consists in heating up the wax to soften it, coating the skin with said wax using a spatula so as to form strips, and then once the wax has hardened, of peeling off these strips taking with them the hairs caught in the wax. The wax must then be recovered free of the hairs. To this end, the strips are reheated until a liquid has been obtained which will then be filtered.

Known devices, for professional use allow these various steps to be carried out. They comprise a lower recipient—or drawing recipient—and an upper recipient—or filtering recipient—provided with a spout overhanging the lower recipient. The temperature in the latter is held at around 60° C. The wax can be drawn therefrom for immediate application on the skin. Once the strips have been removed, they are placed in a filter that is inserted in the upper recipient, and heated to a temperature of 120° C. or so, where they melt. The resulting liquid wax runs through the filter and returns to the lower recipient via the spout while the hairs are retained in the upper recipient by the filter.

With reduced bulkiness in mind, the appliances for domestic use comprise just one recipient that serves as a drawing recipient during the depilation stage itself and that is then heated to a higher temperature for filtering purposes.

These domestic appliances have, however, a certain number of drawbacks. As the depilation itself must be completed before filtering of the wax can commence, firstly the overall time taken for the operation is augmented and secondly, the strips removed must be laid somewhere before they can be put into the recipient. During filtering, the filter must be lifted to allow the filtered wax to flow through. This handling operation can be dangerous since the wax at this point is at a temperature of 120° C.

The object of the present invention is to provide a twin-recipient device whose dimensions are compatible with domestic usage.

The invention therefore relates to a device for wax depilation, comprising a body, a drawing recipient borne by the body and coupled to heating and regulating means, a filtration recipient also coupled with heating means, and which when the device is in use, is raised and laterally off-set with respect to the drawing recipient, and a spout intended for providing a spill-way from the bottom of the filtering recipient to the drawing recipient.

According to the invention, the device is characterized in that the filtering recipient is movably mounted with respect to the body between the aforesaid operational position wherein it overhangs the body, and a fold-away position wherein it is brought back above the drawing recipient.

When in the operational position the device affords all the advantages of twin-recipients devices. In particular, provisions can be made such that the upper recipient leaves substantially total access to the lower recipient.

On the other hand, when folded away, the two recipients are substantially vertically aligned such that the horizontal dimensions of the device are analogous to those of a single-recipient device.

A second aspect of the invention relates to a method for wax depilation by means of a device comprising a drawing recipient whose bottom is coupled to heating means and to a thermostat, a filtering recipient also coupled to heating means and which, when the device is in use, is raised and laterally off-set in relation to the drawing recipient, and a spout that serves as a spill-way from the bottom of the filtering recipient down to the drawing recipient. In this method the wax is softened in the drawing recipient, spread onto the skin, left to cool thereon, removed and placed into a filter sitting in the filtering recipient.

In accordance with the second aspect of this invention, the method is characterized in that from the spout, the filtered wax is fed directly to the bottom of the drawing recipient.

The wax from the filtering recipient is too hot to be re-used forthwith. By feeding it to the bottom of the drawing recipient, immediate re-use thereof is obviated. Additionally, this wax greatly affects the thermostat nearby. The latter stops the heating straightaway thereby taking account of the calorific effect caused by the wax arriving from the filtering recipient. These outcomes are especially advantageous when it comes to domestic use since the drawing recipient then has a low volume capacity and the wax from the filtering recipient may well have a redhibitory effect on the temperature of the ready-to-use wax.

Figure 2:
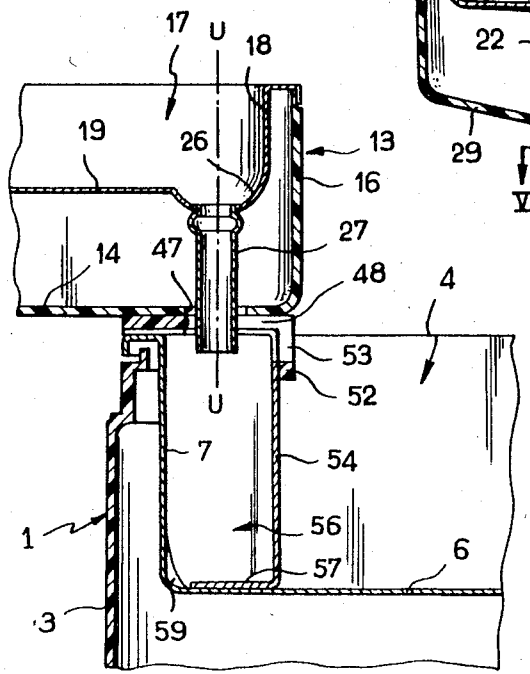
Figure 3:
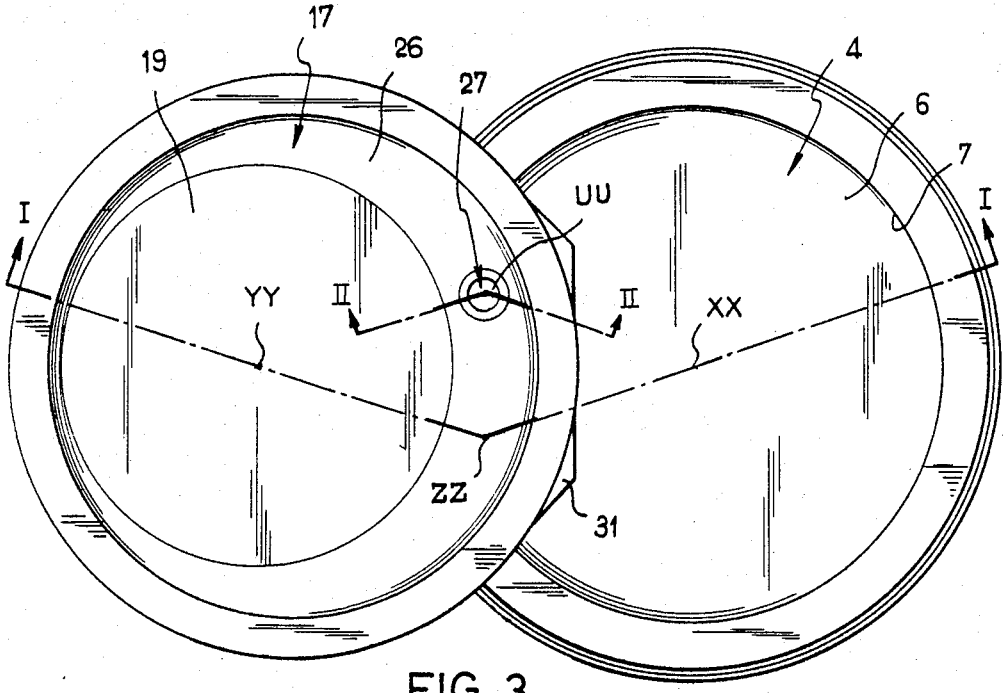
Figure 4:
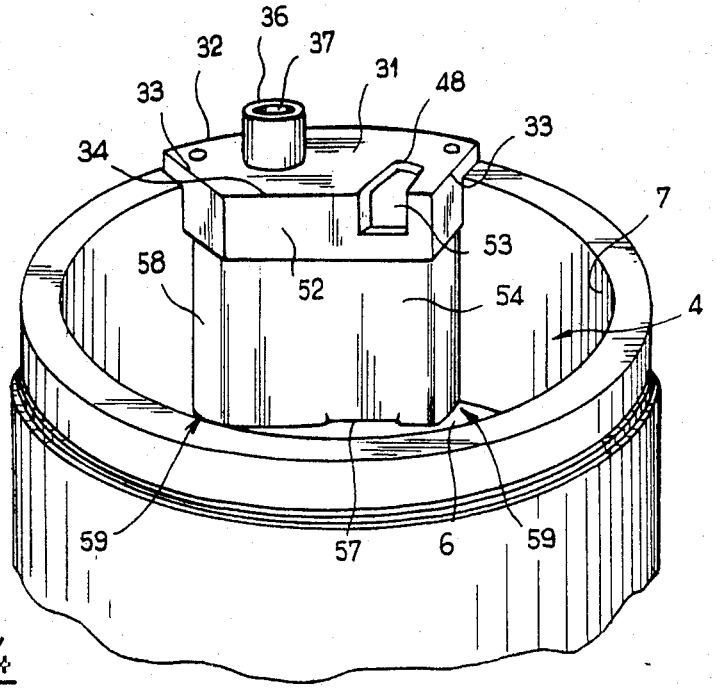
Figure 6:
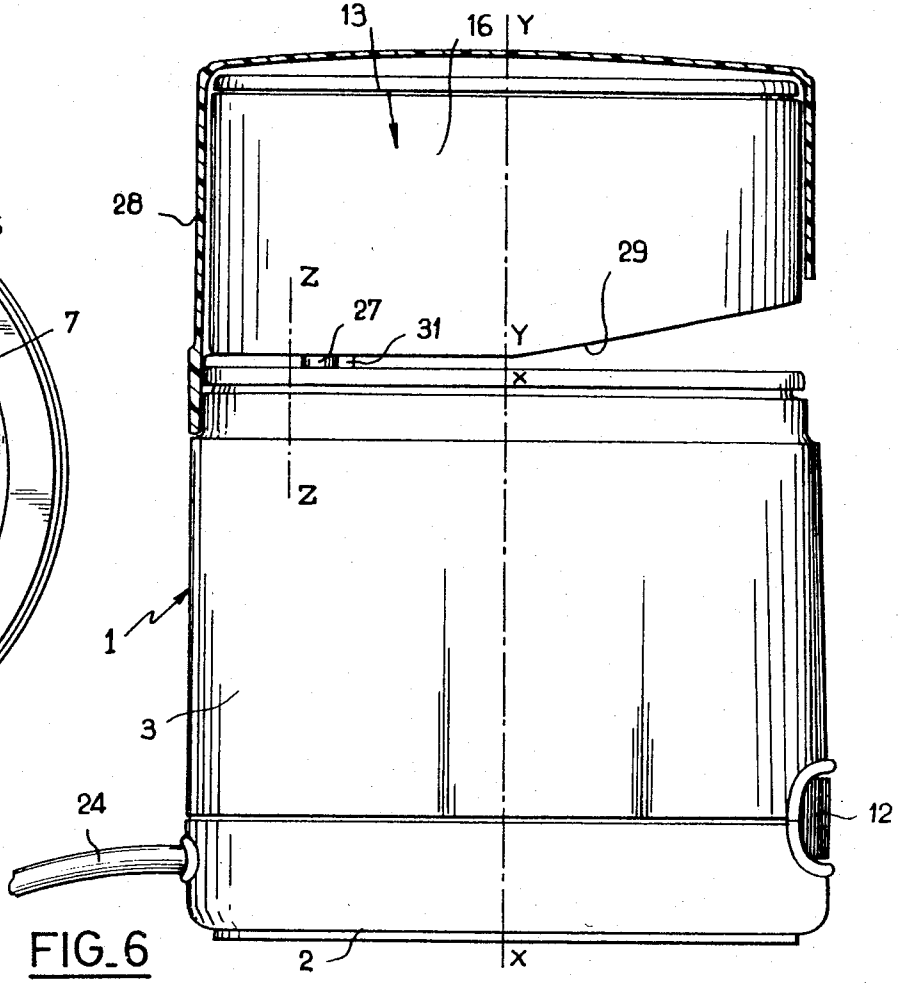
Figure 5:
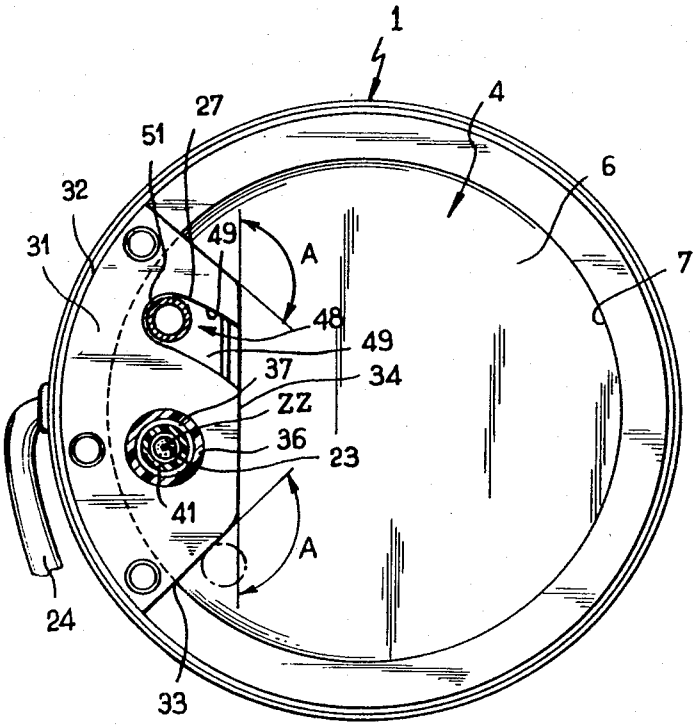

Other aspects and advantages of the invention will become apparent from the ensuing description in relation to the drawings appended hereto, given as non-exhaustive examples, in which:

FIG. 1 is a view of the device when in use, in the form of a sectional view along the dihedron I—I in FIG. 3 running through the recipient's axes and having its edge at their mutual pivoting axis, FIG. 2 shows a view analogous to that in FIG. 1, but merely a partial one, and in the form of a sectional view along the dihedron II—II in FIG. 3 whose edge corresponds to the spout axis, FIG. 3 is a plan view of the device shown in FIGS. 1 and 2, FIG. 4 is a partial view in perspective showing the drawing recipient prior to installation of the filtering recipient, FIG. 5 is a sectional view along the plane V—V in FIG. 1; and FIG. 6 is a side-elevational view showing the device in the folded position, the lid being seen in axial cross-sectional and partly broken away.

The device comprises a housing 1 made of plastic having a base 2 and a side wall 3. The housing 1, having a vertical axis XX when its base 2 rests on a horizontal surface, is substantially cylindrical.

Installed in the upper part of the housing 1 is an aluminum drawing recipient 4 consisting of a bottom 6 and a cylindrical wall 7, having an axis XX, whose upper edge is contiguous with that of the wall 3 of the housing 1. The recipient 4 substantially fills the space in the upper part of the housing 1 and is secured to the base 2 of the housing 1 by means of a distance sleeve 8.

Provided against the outer side of the bottom 6 are electrical resistance heating means 9 that are electrically fed via a thermostat 11, the bimetallic strip 10 of which is brought into thermal contact with the bottom 6 of the drawing recipient by a thermal bridge 10*a*. The thermostat 11 controls the heating means 9 such that a temperature of 60° C. or so, adjustable using the rotatable knurled wheel 12, may be held steady in the recipient 4.

The device further comprises an upper housing 13 comprising a bottom 14 and a cylindrical wall 16 lying about an axis YY parallel to the axis XX, whose diameter is close to that of the housing 1, but whose height is approximately 2.5 times smaller than that of the housing 1. A filtering recipient 17 consisting of a cylindrical wall 18 and a bottom 19 is seated in housing 13. The filtering recipient 17, in which a flexible (e.g. cloth) or rigid filter is inserted when in use, takes up virtually the whole useful diameter of the housing 13 and approximately half its depth.

Provisions are made for heating means 22 against the bottom 19 of the recipient 17, on that side of bottom 19 facing bottom 14 of housing 13. The heating means 22 are fed via leads 23 connected, as in the case of heating means 9, to a connector 25 from which runs a 3-lead cable 24 for plugging the device into a power source. The heating means 22 when the device is switched on provide a steady temperature of around 120° C. They consist of a resistor that has an in-built self-setting property based on its ohmic value increasing with temperature.

As shown in FIGS. 2 and 3, the bottom 19 of the recipient 17 is planar apart from a peripheral drain 26 inclined towards the side where it communicates with a spout 27 that runs into the drawing recipient 4.

In accordance with the invention, the upper housing 13 is hinge-mounted on the housing 1 along an axis ZZ parallel to the axes XX and YY.

In the example as shown, the housing 13 is superposed on the housing 1 and the geometric pivot axis ZZ runs inside the two recipients 4 and 17, close to the respective side walls 7 and 18.

Through the aforesaid pivoting action, the filtering recipient 17 is movable between an operational position (FIGS. 1 to 3) and a fold-away position (FIG. 6). In the operational position, the filtering recipient is off-set sidewards with respect to the drawing recipient 4 thereby providing convenient access thereto. The filtering recipient 17 thus overhangs the housing 1 horizontally, as shown in FIGS. 1 and 2. A certain portion of the filtering recipient 17, where the spout 27 is located, is however situated above the drawing recipient 4.

When folded away (FIG. 6), the housing 13 is then aligned with the housing 1, whereupon the axes XX and YY coincide. The device may then be shut using a lid 28 enclosing both the housing 13 and the top of the housing 1, thereby retaining the device in the fold-away position.

The means whereby the housing 13 is pivoted comprise a plastic plate 31 secured to the edge of the drawing recipient 4. It covers the aforesaid edge over a certain angle and protrudes towards the axis XX. Its surface area is such that it is substantially wholly covered by the housing 13 even when the latter is opened out. The plate 31 (FIG. 5) includes an outer lip 32 forming the arc of a circle, two lateral edges 33 which if extended would cut the axis XX, and an inner rectilinear edge 34 forming the same obtuse angle A with the two edges 33. The plate 31 is symmetrical with respect to a plane running through the axes XX and YY in the operational position (FIG. 5).

The plate 31, on that face facing housing 13, comprises a cylindrical boss 36 having therethrough a bore 37 whose axis is ZZ, and which is enlarged at the end oriented towards the recipient 4 by a shoulder 38 (FIG. 1).

On the other hand, the bottom 14 of the housing 13 comprises a recess 39 accomodating the boss 36 of the plate 31. Centrally in the recess 39, there is a cylindrical protrusion 41 which is fitted in the bore 37. The protrusion 41, at its end oriented towards the plate 31, includes a profiled flange 42 that snaps into the shoulder 38. The elements 36 to 42 all have an axis which is the axis ZZ and fulfil the pivoting action of the housing 13 with respect to the housing 1.

Furthermore, the protrusion 41 also has an axial bore 43 therethrough. The latter communicates with a flexible conduit 44 running from the bore 37 of plate 31 to an aperture 46 in the wall 7 of the recipient 4, wherein the conduit 44 is sealingly secured. The lead 23 is fitted inside the bore 37 and the conduit 44, between the heating means 22 and the cable 24.

The spout consists of a rigid tube in aluminium whose axis UU is parallel to the axes XX, YY and ZZ. It partially protrudes beyond the bottom 14 of housing 13 via an orifice 47 therein, and permanently extends into the drawing recipient 4.

When the device is in the operational position, the spout 27 is engaged in a curved slot 48 provided in the plate 31 between the boss 36 and the edge 33 which is the farthest therefrom. The slot 48 has side edges 49 forming arcs of circles centered on the axis ZZ and a semi-circular end-edge 51 whose radius is greater than that of the spout 27. In the example shown, the plate 31 is connected by its edges 33 and 34 to a skirt 52 (FIG. 4) oriented towards the bottom 6 of the recipient 4, and the slot 48 is contiguous with a rectangular slot 53 made in the skirt 52.

In accordance with an important feature of the invention, the device further comprises a metal partition 54 which sets aparts a prechamber 56 in the recipient 4 into which the spout 27 opens when the device is in the operation position.

The base of the partition 54 sits adjacent with the bottom 6 of the recipient 4 and is fixed thereto by means of a riveted tab 57.

The upper part of the partition 54 abuts the skirt 52. such that the profile of the partition 54 coincides with that of the plate 31 beneath which the prechamber 56 is located.

In the example as shown, the partition 54 lines the inside of the plate 31 and is duly secured to the edge of the recipient 4 in common with the plate 31. In this particular instance, the partition 54 of course includes slots corresponding to those 48 and 53 in the plate 31 and skirt 52 for the travel of the spout 27.

The two side walls 58 vertically located beneath the edges 33 of the plate 31, each comprise a lower angle chamfered such that formed between these chamfers and the wall of the recipient 4 are two vents 59 linking the prechamber 56 to the recipient 4 in the immediate vicinity of the bottom 6 thereof.

A description will now follow of how the wax depilation device works, where this description includes that of the method in accordance with the invention.

At the start of a depilation operation, the device is arranged in the operational position as shown in FIGS. 1 to 3, wherein the spout 27 abuts against the end-edge 51 of the slot 48. Some wax is placed in the recipient 4 for the purpose of softening it. The desired temperature of the wax is set using the knurled wheel 12. The melted wax is taken from the recipient 4 and spread in strips on the skin. Once the wax has solidified, the narrow strips are removed while making them into rolls that are laid in the filtering recipient 17 duly fitted with the filter 21. The strips are converted therein into a liquid bath which flows through the filter 21 and down the spout 27 into the prechamber 56. Via the vents 59, the overheated wax mingles with the ready-to-use wax in the immediate vicinity of the bottom 6 of the drawing recipient 4. As result, the overheated wax is not directly accessible for use. Additionally, the overheated wax immediately affects the thermostat 11 which cuts off the supply to the heating means 9.

To fold the device away, the housing 13 is pivoted about the axis ZZ. In the example shown, where the axis ZZ lies outside the plane defined by the axes YY and XX (FIG. 3) in the operational position, the rotation required to assume the folded position is less than 180°. When folded, the spout 27 is abutted against that edge 33 of plate 31 which is away from slot 48 (position shown by a dot-and-dash line in FIG. 5). The lid 28 (FIG. 6) may then be fitted in place.

It will be noted that the invention, notably in the embodiment shown, makes ingenious use of the raised and offset position required for the filtering recipient when the device is operative, with a view to achieving, by means of a very straightforward and economical structure, a device affording dimensions in the fold-away position compatible with the criteria of domestic usage.

Of course, the invention is not restricted to the example described and illustrated.

Provisions could be made in particular for the housing such as 13, to be mounted between the ends of two parallel rods whose other ends would be hinged to the edge of the drawing recipient. When ready for use, the bowl would rest on the edge of the drawing recipient, and when folded away, it would nest in the drawing recipient.

Provisions could also be made for the housing such as 13 to be slidably mounted on a slide radially placed on the rim of the drawing recipient. When folded away, the two recipient would sit one on the other and when ready for use, the housing 13 would be fully extended outwards for it to clear the drawing recipient.

I claim:

1. A device for wax depilation, comprising a housing having an inner space for receiving a wax drawing vessel carried by said housing, first heating means adjacent the wax drawing vessel, a wax filtering vessel, second heating means adjacent the wax filtering vessel, and a spout communicating with an aperture in a bottom of the wax filtering vessel, and providing a spillway from the wax filtering vessel to the wax drawing vessel, wherein the wax filtering vessel is raised with respect to the wax drawing vessel and is movably mounted with respect to the housing between an operational position in which said wax filtering vessel overhangs the housing and is off-set with respect to the wax drawing vessel, and a folded away position in which the wax filtering vessel is brought back above the wax drawing vessel.

2. A device in accordance with claim 1, wherein the wax filtering vessel is superposed on the wax drawing vessel and pivoted thereon along an axis that is vertical when in use.

3. A device in accordance with claim 2, wherein the pivot is hollow and has axially running therethrough electrical supply leads for the second heating means.

4. A device in accordance with claim 2, wherein one portion of the wax filtering vessel is located above the wax drawing vessel even in the operational position, and wherein the spout is provided in said portion of the wax filtering vessel and protrudes into the wax drawing vessel.

5. A device in accordance with claim 1, comprising a thermostat beneath a bottom of the wax drawing vessel to regulate the temperature of wax contained therein, and means for guiding wax flowing down from the wax filtering vessel to the bottom of the wax drawing vessel.

6. A device in accordance with claim 5, wherein said guiding means comprise a partition setting apart a prechamber in the wax drawing vessel, said prechamber being positioned vertically below the spout when the device is in the operational position, and wherein the prechamber opens into the wax drawing vessel via at least one opening in the base of the partition.

7. A device in accordance with claim 6, in which the wax filtering vessel is superposed on the wax drawing vessel and hinge-mounted thereon by a pivot lying along a vertical axis while the spout is carried by an area of the wax filtering vessel permanently located above the wax drawing vessel and protrudes therein, wherein, when folded away, the spout lies outside the prechamber, an upper part of the partition being provided with a cut-away for free movement of the spout into and out of the prechamber.

8. A device in accordance with claim 6, wherein the prechamber is covered by a plate carrying the wax filtering vessel pivoting means.

9. A device for wax depilation, comprising a wax drawing vessel, first heating means adjacent the wax drawing vessel, thermostat means adjacent a bottom of the wax drawing vessel and adapted to regulate the temperature in the wax drawing vessel at a first temperature level, a wax filtering vessel, which, in use, is raised with respect to the wax drawing vessel, while a user's access to the wax drawing vessel is left clear laterally of the wax filtering vessel, second heating means adjacent the wax filtering vessel and adapted to generate in the wax filtering vessel a second temperature level higher than the first temperature level, and wax guiding means extending from a bottom region of the wax filtering vessel and opening in the wax drawing vessel adjacent the bottom thereof.

10. A device for wax depilation comprising a wax drawing vessel, first heating means provided adjacent the wax drawing vessel and adapted to generate in the wax drawing vessel a first temperature level, a prechamber laterally of the wax drawing vessel and communicating with the latter adjacent the bottom thereof, a wax filtering vessel which, at least in use, is positioned above the prechamber, leaves clear a user's access to the wax drawing vessel and has a spout extending from a bottom of the wax filtering vessel into the prechamber, and second heating means adjacent the wax drawing vessel and adapted to generate, in the wax filtering vessel, a second higher temperature level.

* * * * *